US007224331B2

(12) United States Patent
Yabu et al.

(10) Patent No.: US 7,224,331 B2
(45) Date of Patent: May 29, 2007

(54) DISPLAY DEVICE AND DRIVE CONTROL METHOD THEREFOR

(75) Inventors: Shigeki Yabu, Kanagawa (JP); Takeo Tsukamoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 532 days.

(21) Appl. No.: 10/697,278

(22) Filed: Oct. 31, 2003

(65) Prior Publication Data

US 2004/0100424 A1 May 27, 2004

(30) Foreign Application Priority Data

Nov. 13, 2002 (JP) ..... 2002-329347

(51) Int. Cl.
*G09G 3/22* (2006.01)

(52) U.S. Cl. ..... 345/75.2; 345/74.1; 345/74.2; 345/76; 345/77; 345/90; 345/94; 345/96; 315/169.1; 315/169.3

(58) Field of Classification Search ..... 345/74.1, 345/75.1, 75.2, 90–96, 45, 55, 72, 73, 76
See application file for complete search history.

(56) References Cited

U.S. PATENT DOCUMENTS

| | | | | |
|---|---|---|---|---|
| 6,104,139 | A | 8/2000 | Elloway et al. | 315/169.3 |
| 6,307,325 | B1 | 10/2001 | Elloway et al. | 315/169.3 |
| 6,307,326 | B1 | 10/2001 | Elloway et al. | 315/169.3 |
| 6,400,091 | B1 | 6/2002 | Deguchi et al. | 315/169.1 |
| 6,437,503 | B1 | 8/2002 | Konuma | 313/495 |
| 6,459,209 | B1 | 10/2002 | Elloway et al. | 315/169.3 |
| 2002/0047513 | A1 | 4/2002 | Nomura | 313/495 |
| 2002/0074947 | A1 | 6/2002 | Tsukamoto | 315/169.3 |
| 2004/0130539 | A1* | 7/2004 | Yabu et al. | 345/204 |

(Continued)

FOREIGN PATENT DOCUMENTS

JP 2000-243218 9/2000

(Continued)

OTHER PUBLICATIONS

C.A. Spindt, et al., "Physical Properties of Thin-Film Field Emission Cathodes with Molybdenum Cones", Journal of Applied Physics, vol. 47, No. 12, pp. 5248-5263 (Dec. 1976).

(Continued)

*Primary Examiner*—Richard Hjerpe
*Assistant Examiner*—Jennifer T Nguyen
(74) *Attorney, Agent, or Firm*—Fitzpatrick, Cella, Harper & Scinto

(57) ABSTRACT

A display device includes a display panel having cathodes, gates, and anodes in which the cathodes and the gates are connected in a matrix manner, and an electron emitter which emits electrons in a state where a voltage is applied only between the cathodes and the anodes and which is provided with the cathode. A display of pixels is performed under a dark state by stopping electron emission from the electron emitter for the anodes by applying a stop voltage between the cathodes and the gates. In addition, a controller controls operation of a circuit for driving a display panel in such a way that a potential of each of the anodes becomes not less than a threshold value potential by which the potential of each of the anodes can perform electron emission from the electron emitter after a predetermined time elapse from starting of application of a drive voltage which provides a specified display state or the stop voltage between the cathodes and the gates when a display starting signal is generated.

21 Claims, 12 Drawing Sheets

FOREIGN PATENT DOCUMENTS

| | | |
|---|---|---|
| JP | 2000-251783 | 9/2000 |
| JP | 2000-268706 | 9/2000 |
| JP | 2002-100279 | 4/2002 |
| JP | 2002-150925 | 5/2002 |
| JP | 2002-170483 | 6/2002 |
| JP | 2002-524816 | 8/2002 |
| JP | 2003-228316 | 8/2003 |
| WO | WO 00/13167 | 3/2000 |

OTHER PUBLICATIONS

M.I. Elinson, et al., "The Emission of Hot Electrons and the Field Emission of Electrons From Tin Oxide", Radio Engineering and Electronic Physics, No. 10, pp. 1290-1296 (Jul. 1965).

C.A. Mead, "Operation of Tunnel-Emission Devices", vol. 32, No. 4, pp. 646-652 (Apr. 1961).

* cited by examiner

DISPLAY DEVICE AND DRIVE CONTROL METHOD THEREFOR

BACKGROUND OF THE INVENTION

1. Field of the Invention

This invention relates to a display device used for a monitor for a computer and a television, and particularly a display device having three terminals of an anode, a cathode, and a gate, in which the cathode and the gate are connected in a matrix manner, and a drive control method therefor.

2. Description of the Related Art

Recently, a flat-typed display device has been noticed which uses an electron emission element.

The electron emission element is grouped as a hot cathode type and a cold cathode type. The cold cathode type is mainly used for the display panel of the flat-typed display device. As such a cold cathode type, a field emission type (hereinafter called "FE-type"), a metal/insulating layer/metal (hereinafter called "MIM-type"), a surface conducting type (hereinafter called "SC-type") and so on are known.

A famous FE-typed example is disclosed in following document; "C. A. Spindt. "Physical properties of thin-film field emission cathodes with molybdenium cones", J. Appl. Phys., 47,5248 (1976). A known MIM-typed example is disclosed in following document; "C. A. Mead, Operation of Tunnel-Emission Devices", J. Appl. Phys., 32,646 (1951). A known SC-typed example is disclosed in following document; "M. I. Elinson, Radio Eng. Electron Phys., 10,1290 (1965).

A display panel using any of the electron emission elements as an electrical source is realized by a constitution having a substrate where cathodes and gates are formed in XY-matrix manners, and anodes having a fluorescent member opposing to the substrate are arranged, thereby electrons emitted from an electron emitter of the cathode are irradiated onto the fluorescent member at the anode side resulting in allowing the fluorescent member to be emitted.

As such an electron emitter, an electron emitter made of a carbon group material or a fibrous material having a smaller working function for electron emission and a lower threshold voltage is being noticed. Examples of usage of these electron emission elements are disclosed in before-mentioned Patent documents 1 to 3.

In any of these documents, it is disclosed that fluerene, diamond, diamond-like carbon (DLC), carbon nano tube (CNT), fibrous carbon, or the like is used as an electron emitter.

Thus in case of three terminals type of an electron emission device having a lower threshold voltage, a voltage is not applied between cathode and gate. Merely a normal high voltage (called "anode potential") has only to be applied between anode and cathode, resulting in that electrons are emitted from a electrical releasing member being provided at the cathode under field electron emission phenomenon. Accordingly, when emitted, electron emission is performed without applying a voltage between cathode and gate. On the other hand, when not emitted, electron emission is refrained by applying a stop voltage between cathode-gate. An operation like this will now be defined as "normally-on-type" operation.

Hereinafter, a single normally-on-type electron emission device using an electrical emitting member made of carbon fiber will be picked up and explained as an example.

FIG. 12A and FIG. 12B are schematic views showing a voltage distribution of a single electrical releasing member. FIG. 12A shows a voltage distribution in a drive state in which electron emission is performed. FIG. 12B shows that in a stop state in which electron emission is stopped.

In a state shown in FIG. 12A, an electrical field which is larger than a threshold value electrical field that electron emission will be started in an electron emitter 5 on a cathode 2, is generated only using a voltage between the cathode 2 and an anode 6. Namely, FIG. 12A shows a drive state in which an electron emission occurs. Now, such a state is called "normally-on-state".

For example, if a threshold electrical field of the electron emission member 5 is defined by 3 V/μm, if the anode 6 is provided at a position of 2 mm away from the cathode 2, and if the cathode voltage is applied by 0 V and the anode potential between the cathode 2 and the anode 6 is applied by 6 kV, the electron emission will be started.

In order to establish a preferable normally-on-state, higher anode potential may be applied. The anode potential may be decided depending on an electrical field intensity by which a necessary current density can be obtained by a voltage-current characteristic of the electrical emission device.

For example, if the necessary current density is obtained at the electrical field intensity having 5 V/μm and if the anode 6 is provided at a position of 2 mm away from the cathode 2, 10 kV has only to be applied as the anode potential.

FIG. 12A shows a mode of equipotential surfaces at this time. In FIG. 12A, there exist the substantially equipotential surfaces between the anode 6 and the electron emitter 5, and the electrical field intensity near the electrical emitter 5 becomes about 5 V/μm, resulting in that electron emission will occur.

Further, a voltage to be applied between the cathode 2 and the gate 4 for electron emission should be a voltage except for a voltage which prevents the electron emission by the anode potential. Namely, any voltage except for 0 V can be also available. More preferably, the voltage may be a voltage which provides no uncomfortable affection to the electrical field intensity. In the above-mentioned normally-on-state, an example is shown in which the voltage is set to be 0 V.

On the other hand, in the state shown in FIG. 12B, if a negative potential is supplied to a gate 4 with respect to a cathode 2, an electrical field intensity to be received from the anode 6 becomes smaller near an electrical emitting member 5 i.e., the electrical field intensity becomes intensity of a necessary threshold value electrical field or smaller, resulting in that the electron emission is stopped. The voltage between the cathode 2 and the gate 4 at this time is called stop voltage".

The equipotential surface when a stop voltage is applied between the cathode 2 and the gate 4 will be explained as follows. As shown in FIG. 12B, voltage of each of The cathode 2 and the electrical emitting member 5 is 0.0 V while potential of the gate 4 becomes negative, so that a distance between the equivalent voltage surfaces near the electrical emitting member 5 becomes wider, resulting in that it will be found that the electrical field becomes smaller.

The stop voltage to be applied between the cathode 2 and the gate 4 at this time will be decided as follows. First, necessary electrical field intensity is decided by a threshold value electrical field of the electrical emitting member 5 and a necessary electrical field intensity by the anode potential in a normally-on-state, and thereafter the stop voltage is properly decided by design of a dimension of the electrical emitting member 5, a distance between a cathode and a gate, a dimension of a gate and so on.

As above, in the normally-on-typed electrical emitting member, electron emission is performed merely by applying a voltage between a cathode and an anode, and electron emission is controlled by stopping electron emission by applying a stop voltage between the cathode and a gate. As a result, there is no necessity that a voltage between cathode and gate becomes equal or more than a threshold value, resulting in that stable drive control becomes possible at lower voltage.

[Patent Document 1]

Japanese Patent Laid-open No.2000-251783 gazette

[Patent Document 2]

Japanese Patent Laid-open No.2000-268706 gazette

[Patent Document 3]

Japanese Patent Laid-open No.2002-100279 gazette

Then, it has been considered that such a normally-on-typed electron emission device is applied to an XY-matrix-typed and flat-typed display device. In a case where such a flat-typed display device, a voltage is applied between cathode and gate, which provides an electrical field intensity having a value being equal to or more than a threshold value, and when a stop voltage is not applied between cathode and gate, all-white-display will be performed at a most luminosity over all the surface of the display screen.

Accordingly, when such a flat-typed display device is used as a television or a computer monitor, if the all-white-display is performed even for a short time, a user often incorrectly recognizes that the device might be out of order and/or feels uncomfortable.

Further, like the above-mentioned fibrous material or nano constitutional body, when an electron emitter having a relatively low threshold value voltage for emitting electrons, if a voltage between a cathode and a gate lies under no-control state, a condition is continuously kept that electron emission is apt to occur owing to the voltage between the cathode and an anode, resulting in that though all-white display might not be established at a most luminosity, there might be a fear that light-emission occurs owing to unintentional electron emission.

Above all, all-white-display and unintentional electron emission are apt to occur in a case where an anode potential is transited from a stop state to a supply state depending on occurrence of a display start signal, for example when the display device itself is turned on and/or when the present display mode is switched from a non-display mode to a display mode in order to save electrical power.

SUMMARY OF THE INVENTION

The present invention has its object to provide a display device and its display control method which can control occurrence of unintentional display state and/or unintentional light emission, in a case where an anode potential is changed from a stop state to a supply state depending on occurrence of a display start signal.

In the present invention, in order to overcome the above problems, an electron source is used a cathode, which has a threshold value such that electron emission is performed in a state where an anode voltage is applied between cathodes and anodes. In a display device such as a flat-typed display which is XY-matrix-typed which controls display state by stopping electron emission by applying a stop voltage between a cathode and a gate near the cathode, for example, in such a case where a power is on, since a display starting signal is generated, after a predetermined control voltage is at least applied between the cathode and the gate, an average electrical field intensity which generates by the anode voltage becomes not less than a threshold value of the electron source.

The gist of the present invention is stated as below.

(1) A display device comprising:

a display panel having cathodes, gates, and anodes in which the cathodes and the gates are connected in a matrix manner;

an electron emitter which may emit electrons in a state where a voltage is applied only between the cathodes and the anodes and which is provided with the cathode;

in which display of each of pixels is performed under a dark state by stopping electron emission from the electron emitter for the anodes by applying a stop voltage between the cathodes and the gates, and a control means which controls operation of a circuit for driving a display panel in such a way that a potential of each of the anodes becomes not less than a threshold value potential by which the potential of each of anodes can perform electron emission from the electron emitter after a predetermined time elapse from starting of application of a drive voltage which may provide a specified display state or the stop voltage between the cathodes and the gates when a display starting signal is generated.

Thereby, when a potential of anode is transited from a stop state to a supply state corresponding to generation of the display starting signal, occurrence of unintentional display state and unintentional light emission can be refrained.

(2) The display device according to (1), wherein application of the stop voltage between the cathode and the gate and the drive voltage which may provide the specified display state is performed for all the pixels of the display panel at the same time.

Thereby, when a potential of an anode is transit from a stop state to a supply state according to occurrence of a display starting signal, so that a whole image screen can be held in all-black (dark) state at the lowest luminosity level or a specified display state.

(3) The display device according to (1), wherein a scanning selective potential is supplied to at least one line scanning wiring, a scanning non-selective potential is supplied to the remaining scanning wirings, a predetermined potential which generates the darkest state for each pixel is supplied to all the columns of the display panel in synchronization with supply of the scanning selective potential or a predetermined modulation potential is supplied, whereby the stop voltage or the drive voltage which may provide the specified state is applied between the cathodes and gates.

Thereby, using an operation as same as a usual display operation, even when a potential of the anode is transited from a stop state to a supply state resulting in an anode potential corresponding to all-white (light), a screen image can be held under all-black (dark) state or a specified display state.

(4) The display device according to (1), wherein the display panel drive circuit has:

an anode power supply circuit for supplying the anode potential;

a cathode drive circuit for driving the cathodes;

a gate drive circuit for driving the gate; and a drive power supply circuit for supplying a driving reference voltage for generating a drive voltage which may provide the stop voltage or the specified state to the cathode drive circuit and the gate drive circuit.

Thereby, a power supply state to each of circuits can be finely controlled.

(5) The display device according to (4), wherein the drive power supply circuit starts supplying the driving reference potential under a state where a drive potential for a logic circuit to the cathode drive circuit and the gate drive circuit, supply of the driving reference potential starts, and thereafter the cathode drive circuit and the gate drive circuit start application of the stop voltage or the driving voltage which may provide the specified display state.

Thereby, a high voltage is applied to the device after a low voltage is applied thereto, and a voltage is sequentially applied to each of circuits, so that an erroneous operation and breakage of the circuits.

(6) The display device according to (4), wherein a terminal when application of the stop voltage or the driving voltage which may provide the specified display state, the anode power supply circuit holds the anode so as to have a specified potential sufficiently lower than the threshold value potential which may emit electrons from the electron emitter under a state where a drive potential for a logic circuit is supplied to the anode power supply circuit.

Thereby, electrostatic charging of anode is prevented, so that a timing when a potential of the anode is over a threshold value.

(7) The display device according to (4), wherein after application of the stop voltage or the drive voltage which may provide the specified display state starts, application of drive voltage is permitted based on input display image data from the cathode drive circuit and the gate drive circuit to the display panel.

Thereby, defect of display can be prevented, so that display based on input display image data can be smoothly transited.

(8) The display device according to (1), wherein after the voltage between cathodes and gates is transited from an unstable state to zero, application of the stop voltage and the drive voltage which may provide the specified display state starts.

Thereby, inferior affection can be prevented owing to electrostatic charging.

(9) The display device according to (1), wherein any one of first and second supply steps is adopted, the fist step of supplying scanning non-selective potential which may apply the stop voltage irrespective of a potential of the other wiring to any one of cathode wirings and gate wirings which are defined by scanning wirings of the display panel; and the second step of supplying a modulation potential which may apply a drive voltage that provides the specified display state or the stop voltage irrespective of a potential of the other wiring defined by the scanning wirings to any one of cathode wirings and gate wirings which are defined by modulation signal wirings;

whereby the stop voltage or the drive voltage which may provide the specified display state is applied between the cathodes and gates.

Thereby, unintentional emission of image screen can be prevented merely using a drive circuit at a scanning side or a modulation signal side.

(10) The display device according to (1), wherein a modulation potential to be supplied to any one of the cathode wiring and the gate wiring which are defined by modulation signal wirings of the display panel is a potential selected from three or more levels, and potentials at two or more levels from among them are potentials which generate a drive voltage which may emit electrons by allowing the two or more level potentials to be supplied in synchronization with the scanning selective potential, and one of them is a potential which generates the stop voltage.

(11) The display device according to (1), wherein the electrical emitter is a fibrous constitutional body made of semiconductor or conductor or a nano constitutional body whose main content is carbon.

(12) The display device according to (11), wherein the nano constitutional body includes at least one kind selected from carbon nanotube, graphite nanofiber, amorphous carbon, carbon nonohorne, graphite, diamond like carbon, diamond and fullerene.

(13) A drive control method for a display device having a display panel having cathodes, gates, and anodes in which the cathodes and the gates are connected in a matrix manner; and an electron emitter which may emit electrons in a state where a voltage is applied only between the cathodes and the anodes and which is provided with the cathode; in which display of each of pixels is performed under a dark state by stopping electron emission from the electron emitter for the anodes by applying a stop voltage between the cathodes and the gates, the method comprising:

a application step of applying the stop voltage or a drive voltage which may provide a specified display state between the cathodes and the gates when a display starting signal is generated; and an anode voltage supplying step of allowing a potential of the anode not to be less than a threshold value potential which may emit electrons from the electron emitter after a predetermined time elapse from starting of the application step.

(14) The drive control method for the drive device according to (13),wherein a driving power supply circuit starts supplying a driving reference potential for generating the stop voltage or a drive voltage which may provide the specified display state to the cathode drive circuit and the gate drive circuit under a state where a drive potential for a logic circuit is supplied to a cathode drive circuit and a gate drive circuit;

thereafter, the application step starts, and at a starting time of the application step, an anode power supply circuit holds the anode at a specified voltage which is sufficiently lower than a threshold voltage which may perform electron emission from the electron emitter under a state where the drive potential for the logic circuit is supplied to the anode power supply circuit: and further thereafter, the anode potential supplying step starts, the anode is held at a voltage which is sufficiently higher than the threshold potential which may perform electron emission from the electron emitter, and application of the drive voltage for display is permitted based on a display image input to the display panel from the cathode drive circuit and said gate drive circuit.

DETAILED DESCRIPTION OF THE INVENTION

Hereinafter, an aspect of preferable embodiment of the present invention will be explained illustratively and in detail, referring to attached drawings. It should be noted that dimension, material, FIGURE, arrangement, and so on described in the embodiment, except for particularly specified description, a scope of the present invention is not limited to merely them.

First Embodiment

Figure 1:
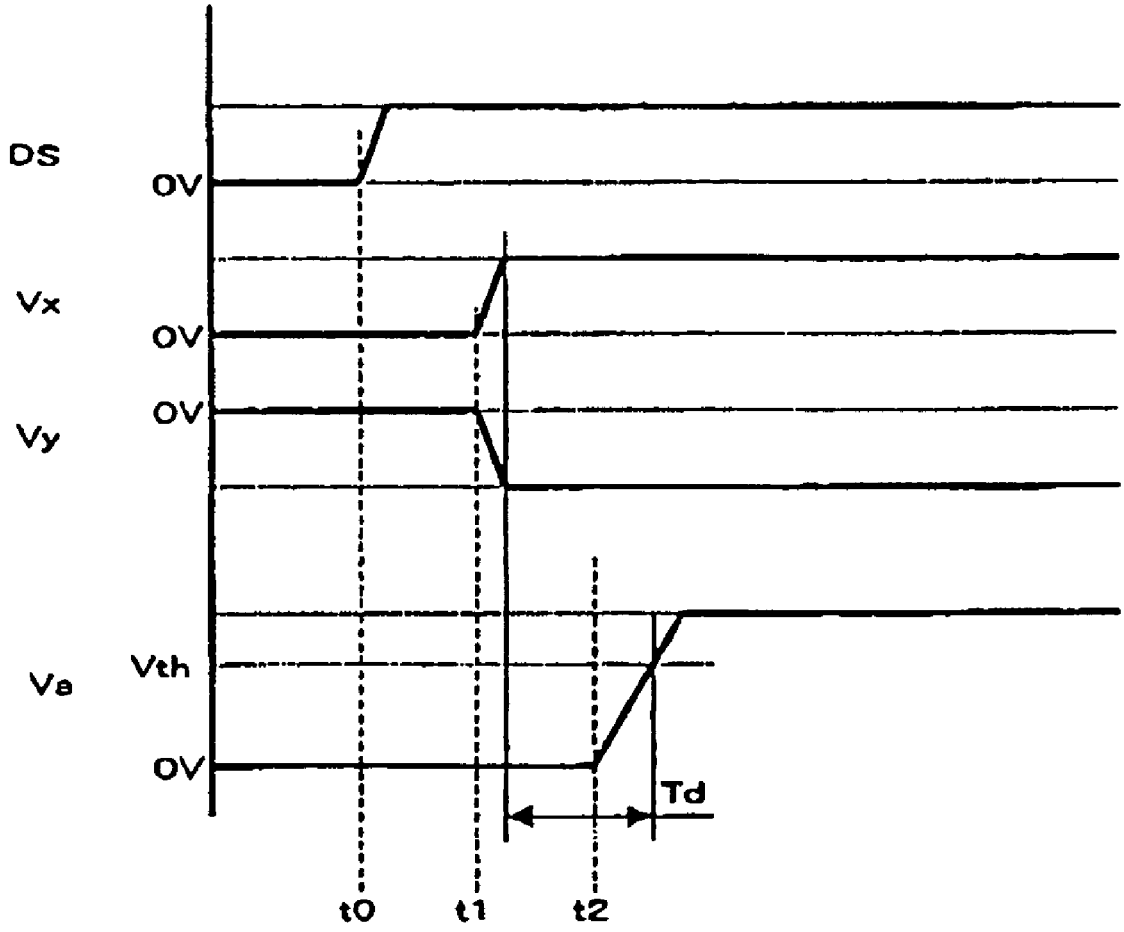
FIG. 1 shows a timing chart of drive control method of display device according to a first embodiment of the present invention.
Figure 2:
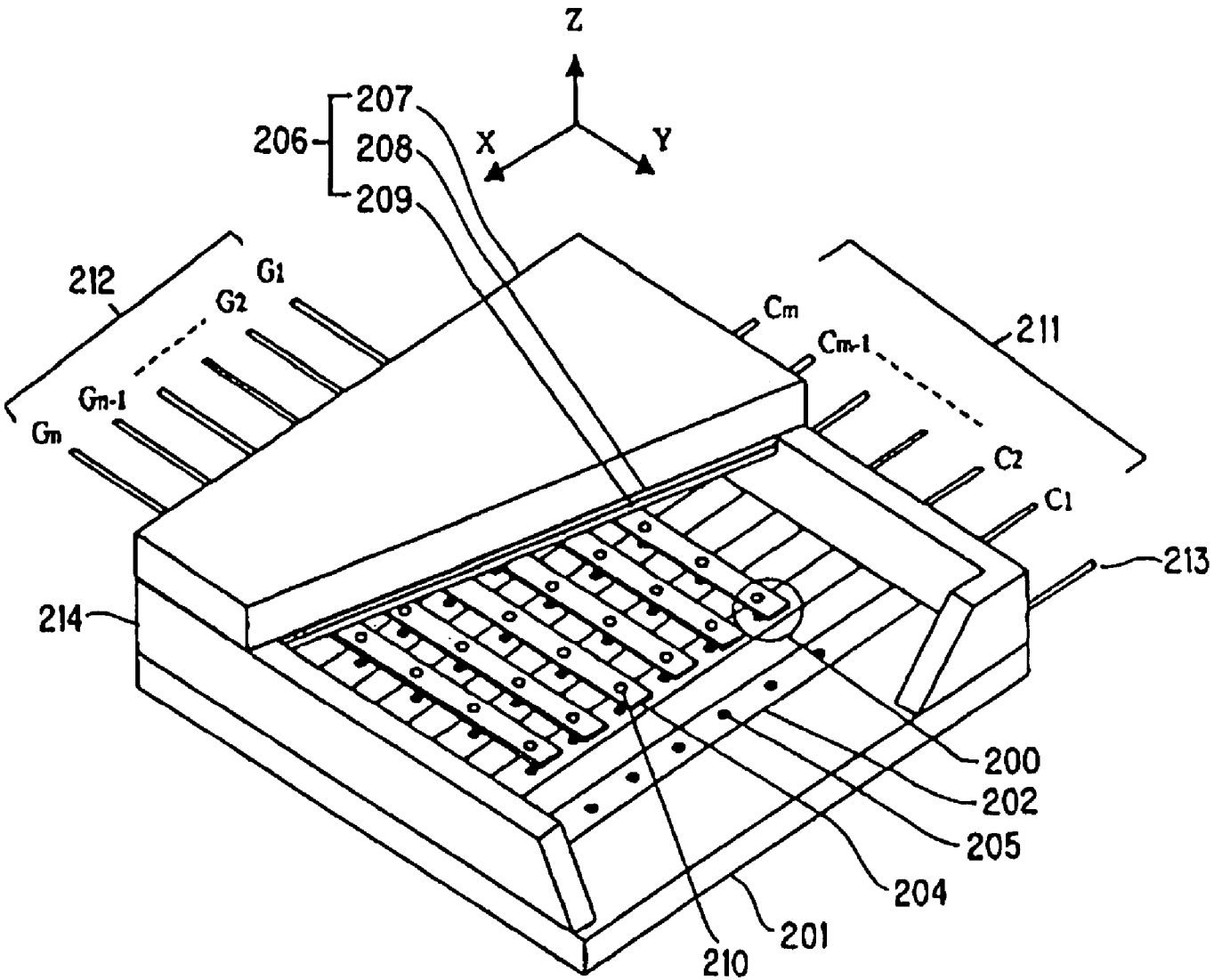
FIG. 2 shows a partially exploded schematic drawing of a display panel used in the fist embodiment of the present invention.
Figure 3:
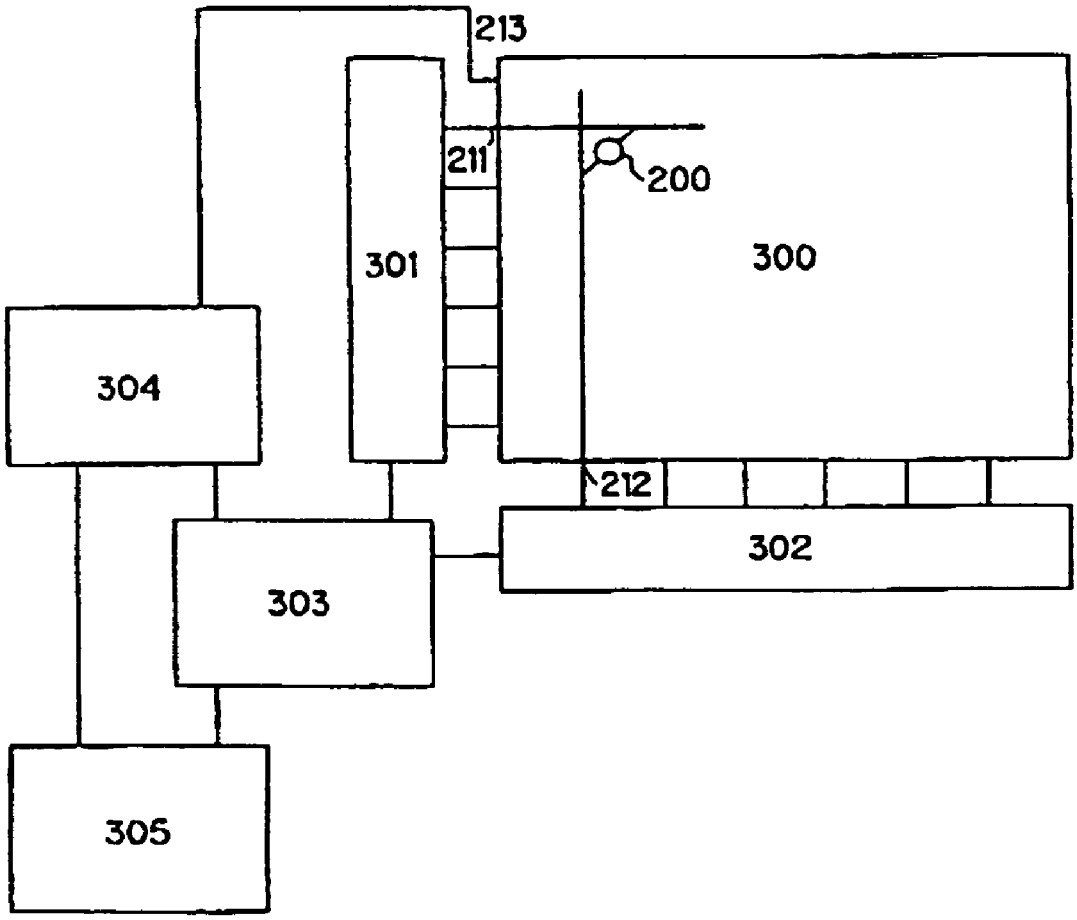
FIG. 3 shows a block diagram of drive control system of display device in the fist embodiment of the present invention.

FIG. 1 shows a timing chart for explaining about a drive control method of display device in the first embodiment of the present invention. FIG. 2 shows a constitution of display panel used in the first embodiment of the present invention. FIG. 3 shows a block diagram of drive control system of display device in the fist embodiment of the present invention.

A display device, i.e., a flat-typed display relating to the present embodiment, a plurality of electron emission elements being matrix-connected are arranged in a matrix manner.

The constitution shown in FIG. 2 has an electrical source substrate 201, a face plate 206, an outside frame 214, row-direction wirings 211, column-direction wirings 212, and a normally-on-typed electron emission device.

A fluorescent member 208 which is provided as an image forming member on the face plate 206 corresponding to the top portion of the electron emission device 200 is disposed and aligned, opposing to the simple matrix electrical source substrate 201.

An aluminum group wiring material is provided on the fluorescent member 208 as a metal back 209 which is functioned as a high voltage applying conductor by vapor deposition or the like. A high voltage terminal 213 for providing a high voltage is electrically connected to the metal back 209.

An anode substrate 207 is provided on a surface of the fluorescent member 208 at the side being opposite to the metal back 209.

In FIG. 2, the row-direction wirings 211 are constituted by C1, C2, . . . Cm, i.e. m-numbers of wires, arranged in a striped manner, and each of the wires forms the cathode 202. The row-direction wirings 211 are made of a conductive material such as aluminum or silver formed using vapor deposition or the like. It should be noted that material, thickness, and width of the wiring are appropriately designed, and the manufacturing method is also appropriately selected.

An electron emitter 205 is formed at the position of the electron emission device 200 on the cathodes 202 which are arranged in the stripe manner. It should be noted that the electron emitter 205 may be made of carbon group having a low electrical emitting threshold value as above-mentioned or fibrous nano-constitutional body made of conductor.

The row-direction wirings 211 are constituted by G1, G2, . . . , Gn, i.e. n-numbers of wires, which are arranged in a striped manner, being perpendicular to the row-direction 211. Each of the wirings forms a gate 204.

The gates 204 being arranged in the stripe manner are provided with a hole portion 210 having an opening at a portion corresponding to the above portion of the electron emitter 205 of the cathode 202.

The gate 204 and the hole portion 210 arranged in the stripe manner on the cathode 202 (C1) lying at the most front side are not shown for easier viewing.

The cathodes 202 are arranged at the row-direction wirings 211 while the gates 204 are arranged at the column-direction wirings 212. However, this arrangement can be reversed.

An insulator layer between the other layers, which is unshown for easier viewing, is arranged between m-numbers row-direction wirings 211 and n-numbers column-direction wirings 212. By the insulator layer, electrical insulating state is established (m, n: positive integral numbers). It should be noted that such an insulator layer is not disposed at portions corresponding to the electron emitter 205 and the hole portion 210.

The unshown insulator layer between the other layers are formed using a sputtering method or the like. For example, the insulator layer over a whole surface or a part of the surface of the electrical source substrate 201 in which the row-direction wirings 211 are formed. Particularly, regarding as the insulator layer, thickness, material, processing method, or the like are appropriately selected so as to endure a potential difference of a cross section between the row-direction wirings 211 and the column-direction wirings.

The row-direction wirings 211 and the column-direction wirings 212 are drawn out as external terminals, respectively.

In the present embodiment, a pair of electrode layers in itself by which the electron emission element 200 is constituted also serves as function of m-numbers of row-direction wirings 211 and n-numbers of column-direction wirings 212. Further preferably, following arrangement is available. A cathode 202 and a gate 204 are arranged independently of wiring by each element. A plurality of Y-direction independent gates 204 are commonly connected using the column-direction wirings while a plurality of X-direction independent gate 202 are commonly connected using the column-direction wirings. For this arrangement, it is preferable that the gate electrodes and the gate wirings, and the cathode electrodes and the cathode wirings are separately formed, respectively.

As shown in FIG. 3, a scanning signal applying means 301 which applies a scanning selective signal for selecting a row of the electron emission element 200 arranged in X-direction is connected to the row-direction wirings 211.

On the other hand, a modulation signal applying means 302 for modulating each column of the electron emission device 200 arranged in Y-direction is connected to the column-direction wirings 212.

A stop voltage between cathode 202 and gate 204 which applies to each electron emission element 200 is supplied as a differential voltage between a modulation signal and a scanning signal to be applied to the element 200. It should be noted that in the present embodiment, the row-direction wirings 211 are regarded as the cathodes 202, to which a zero potential or a positive potential is supplied as the scanning signal while the column-direction wirings 212 are regarded as the gate 204, to which a zero potential or a negative potential is supplied as the modulation signal.

The electron emission device 200 by which each pixel is constituted, is driven as follows.

A high potential is supplied to a metal-back 209 (hereinafter called "anode"). An anode potential is retained as an enough value to emit electrons from the electron emitter 205 depending on a voltage between the cathode 202 and the gate 204.

Under such a condition, a positive potential is supplied as a scanning-no-selection voltage (which is a voltage if a scanning is not selected) to the cathode 202 of the row-direction wirings 211, which corresponds to non-selective scanning. And a zero potential is supplied as a scanning selection voltage to the cathode 202 of the row-direction wirings 211, which corresponds to selective scanning. At the same time, a zero potential or a negative potential is supplied as a modulation signal for the gate 204 of the column-direction 212.

Without depending on a potential (zero potential or negative potential) of the modulation signal in the non-selective row, a voltage between the cathode 202 and an anode is set to a value which does not generate electron emission from the electron emitter 205, so that an electron is not emitted from an electron emitter 205 lying on non-selective row, and a pixel on the row is not lighted on.

On the other hand, in the element for which the modulation signal having a zero potential is provided in a selective row, a voltage between the cathode 202 and the gate 204 becomes zero. An operating voltage between the cathode 202 and an anode is over a threshold value voltage of an electron emission, so that electrons are emitted from the element (emitter) and a pixel is lighted. In the present invention, even in case of normally-on, an only condition of a voltage to be applied between a cathode and a gate for electron emission is satisfied that the voltage is not for preventing electron emission owing to an anode potential (operating voltage between anode and cathode), i.e., not limited to 0 V. Namely, regarding as a bias condition, a gate somewhat may have a positive voltage with respect to a cathode.

In an element to which a modulation signal having a negative voltage is provided in a selective row, a voltage between the cathode 202 and the gate 204 becomes a stop voltage. In spite of that a voltage between the cathode 202 and an anode is over a threshold value of electron emission, by affection of potential of the gate, an electrical intensity at a real electron emitter 205 is not over a threshold value of an electron emission, so that an electron is not emitted from the element and a pixel is not lighted.

Such a scanning is performed, sequentially selecting at least one row, so that scanning of a single screen field will be completed and an image will be displayed corresponding to an input image data to be displayed.

Now, a display starting sequence will be explained, referring to FIG. 1 and FIG. 3.

As shown in FIG. 3, a necessary signal in order to generate a scanning signal and a modulation signal, respectively are supplied to a scanning signal applying means 301 and a modulation signal applying means 302, from a control circuit 303 as a control means. Also, a control signal in order to control operation of an anode power supply circuit 304 is supplied from the control circuit 303.

A main power supply 305 is provided at an upstream side of power supplying in order to supplying a necessary voltage for operation of the control circuit 303 and the anode power supply circuit 304.

Here, it should be noted that the other signal processing circuit necessary for displaying an image, or details of constitutions of the scanning signal applying means 301 and the modulation signal applying means 302 are omitted.

As shown in FIG. 1, when a power supply switch at an upstream side is turned on a display starting signal DS of high level at time=t0 is generated at the control circuit 303 by power supply from the main power supply 305.

After a predetermined necessary time elapse in order to activate the scanning signal applying means 301 and the modulation signal applying means 302 since the display starting signal DS generates, at time t1, a positive potential supply will start from the scanning signal applying means 301 to the cathode 202, and at the substantial same time, a negative potential supply will start from the modulation signal means 302 to the gate 204.

While a period from generation of the display starting signal DS to application of a scanning non-selective signal (Vx) having a positive potential and a modulation signal (Vy) having a negative potential, if voltage of the cathode 202 or the gate 204 is not constant, there is possibility that a voltage between the cathode 202 and the gate 204 is over an electron emission threshold value of the electron emitter 205 resulting in electron emission. Accordingly, if necessary, it is desirable that potentials of the cathode 202 and the gate 204 should be maintained at the same value. Usually, a relationship of Vx=Vy=0V is desirable.

In order to supply a stop voltage between the cathode 202 and the gate 204, a voltage of at least one of the row-direction wirings 211 and the column-direction wirings 212 is changed into a voltage that can apply the stop voltage to the device. Thereafter after a predetermined delay time Td elapse, supply of the anode potential Va for a high-voltage terminal 213 will start at a time t2 so that the anode potential Va is over a voltage Vth at which an electrical field intensity can be obtained over a threshold value electrical field intensity when an electron emits.

As above, in the present embodiment, the cathodes 202 are defined by the row-direction wirings 211 while the gates 204 are defined by the column-direction wirings 212. Accordingly, control may be performed so that a modulation signal at the side of the column-direction wirings 212 becomes a negative voltage which can generate a whole stop voltage, i.e., so that data which performs all-black display as a display image data, is applied from the control circuit 303 to the modulation signal applying means 302. In this case, the scanning signal may be at a scanning selective potential (zero potential) or may be at a voltage high than that voltage.

Alternatively, all the scanning signals of the row-direction wirings 211 may be at a positive voltage which may generate a stop voltage. In this case, the scanning signal may be at a zero potential or at a voltage smaller than zero. Therefore, both a black display data (negative voltage) and a white display data (zero potential) are available.

In the sequence of FIG. 1, scanning signals at all the row-direction wirings 211 are defined by a positive potential while scanning signals at all the column-direction wirings 212 are defined by a negative potential. A stop voltage is made to be larger, which is applied between the cathode 202 and the gate 204, so that an example in which an electron emission is surely prevented. As above, a voltage of any one of the cathode 202 and the gate 204 may be defined by a voltage which may generate the stop voltage.

A transition time at each of the voltages can be realized by control of the control circuit 303.

Additionally, considering over dispersion of standing time of supplying potentials such as Vx, Vy, and Va owing to difference of performance of constitutional parts, dispersion value electrical field between a plurality of electron emission elements, or a case where a voltage-current characteristics of the electron emission element has a hysteresis It is desirable that a time Td when Va becomes a voltage Vth which generate a threshold value electrical field of the electron emitter 205 since Vx and Vy become a predetermined potential value, is not less than substantially 17 ms or more preferably not less than 33 ms.

After the anode potential Va becomes constant after the anode potential Va has been made to be high, a usual scanning signal and a usual modulation signal are supplied from the scanning signal applying means 301 and the modulation signal applying means 302. Thus, by control them using the control circuit 303, a usual image display will be performed based on an input display image data.

Then, time control (i.e., pulse width modulation) may be performed by a pulse width at a zero potential of the modulation signal in order to perform a gradation display of an image.

By such a sequence, a phenomenon can be prevented that all-white-light-on is established over all the screen by the lightest luminosity when the display starting signal DS occurs, e.g., when a switch is on, or when display restarts.

Additionally, following method is also available. First, the anode potential Va starts to be supplied before a predetermined stop voltage starts to be applied between the cathode 202 and the gate 204 Secondly, a timing can be decided so that a stop voltage is applied between the cathode 202 and the gate 204 before the anode potential Va is over the threshold potential Vth. However, There is always no possibility that an electrical field intensity between the cathode 202 and the anode is over a threshold value electrical field and electrons are emitted. It is desirable that the anode potential Va starts to be supplied after a stop voltage is applied between the cathode 202 and the gate 204.

Following method is also available. When the display starting signal DS occurs, usual scanning signal and modulation signal are beforehand supplied, so that a drive voltage which can provide a specified display state is applied. As a result, it is possible that the anode potential Va stands up while a predetermined display is performed. Even in this case, it can be set that the anode potential Va almost immediately (within 1 sec) stands up, so that there occurs uncomfortable feeling when the display starts.

Second Embodiment

In FIG. 4 to FIG. 9, the second embodiment is shown. In the present embodiment, a constitution of the present invention using various circuits will be explained in more detailed than explained in the first embodiment.

Figure 4:
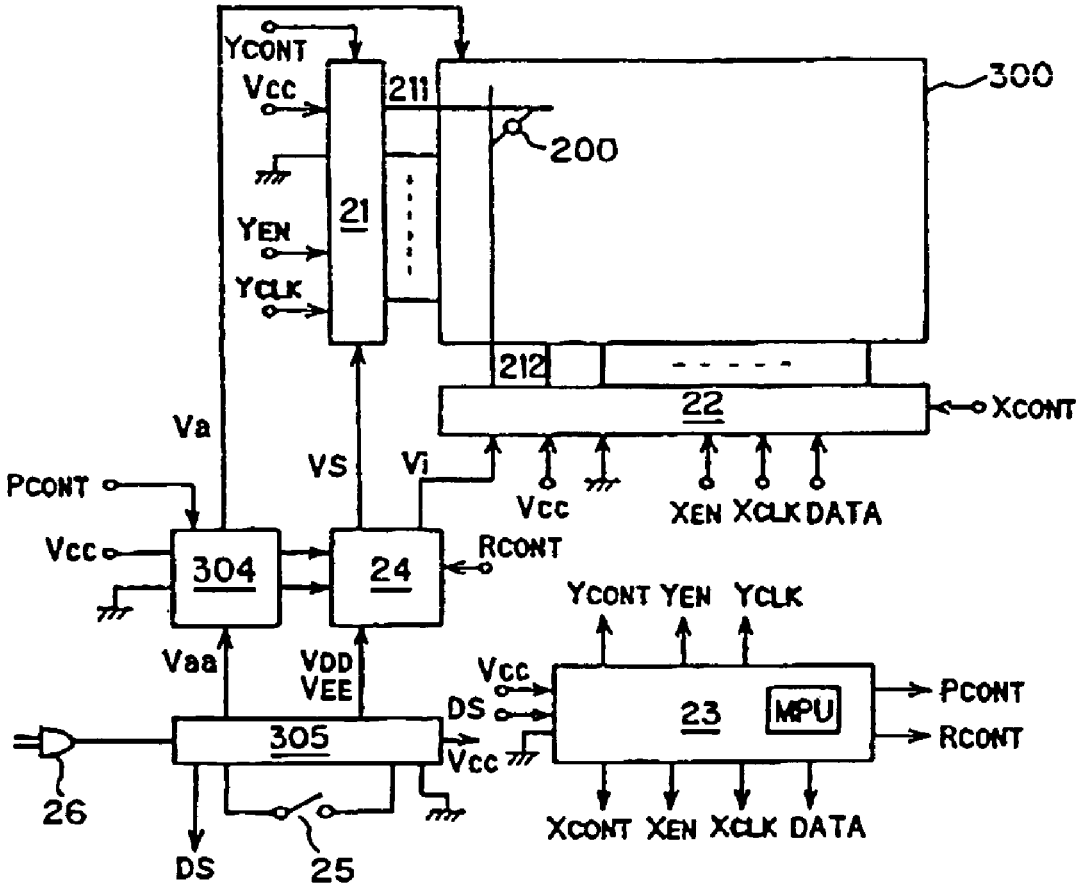
FIG. 4 shows a block diagram of drive control system of display device in the second embodiment of the present invention.
Figure 5:
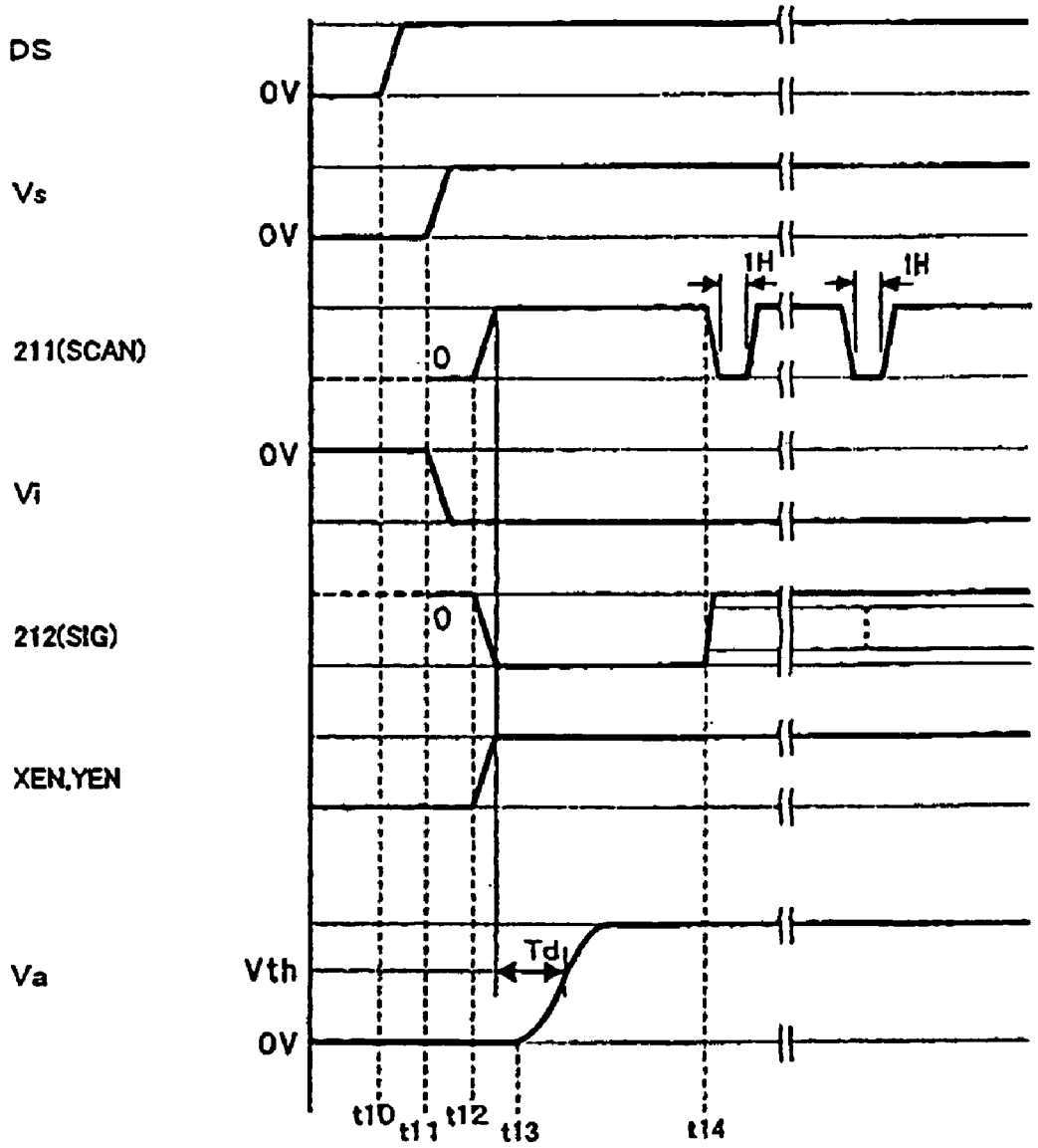
FIG. 5 shows a timing chart of drive control system of display device in the second embodiment of the present invention.

FIG. 4 shows a block diagram of drive control system of display device in the second embodiment of the present invention. FIG. 5 shows a timing chart for explaining about a drive control method of display device in the second embodiment of the present invention.

A display panes 300 has cathodes, gates, and anodes, in which the cathode and the gate are connected in a matrix manner. In FIG. 4, only electron emission device 200 is illustrated, but in fact many elements are arrayed in matrix manners. A display like an example of the display panel 300 has been already explained. So, in this embodiment, the detailed explanation is omitted.

The display panel 300 is provided with an electron emitter at a cathode which can emit electrons in a state where a voltage is applied only between a cathode and an anode. Therein, display is performed as follows. A stop voltage is applied between the cathode and the anode, so that electron emission from the electron emitter for the anode is stopped, resulting in that pixels will lie in dark state whereas a drive voltage is applied between the cathode and the gate, so that electron emission from the electron emitter for the anode is generated, resulting in that pixels will lie in light state.

A display panel drive circuit for driving the display panel 300 has an anode power supply circuit 304 for supplying an anode potential Va to an anode, a cathode drive circuit 21 for driving a cathode, a gate drive circuit 22 for driving a gate, and a drive power supply circuit 24 which supplies driving reference potentials Vs, Vi for generating a stop voltage and a drive voltage which can provide a specified state, to the cathode drive circuit 21 and the gate drive circuit 22.

Preferably, the driving reference voltage Vi is, for example, constituted by three or more driving reference potentials for drive of voltage amplification modulation (PHM) for gradation display.

Figure 6:
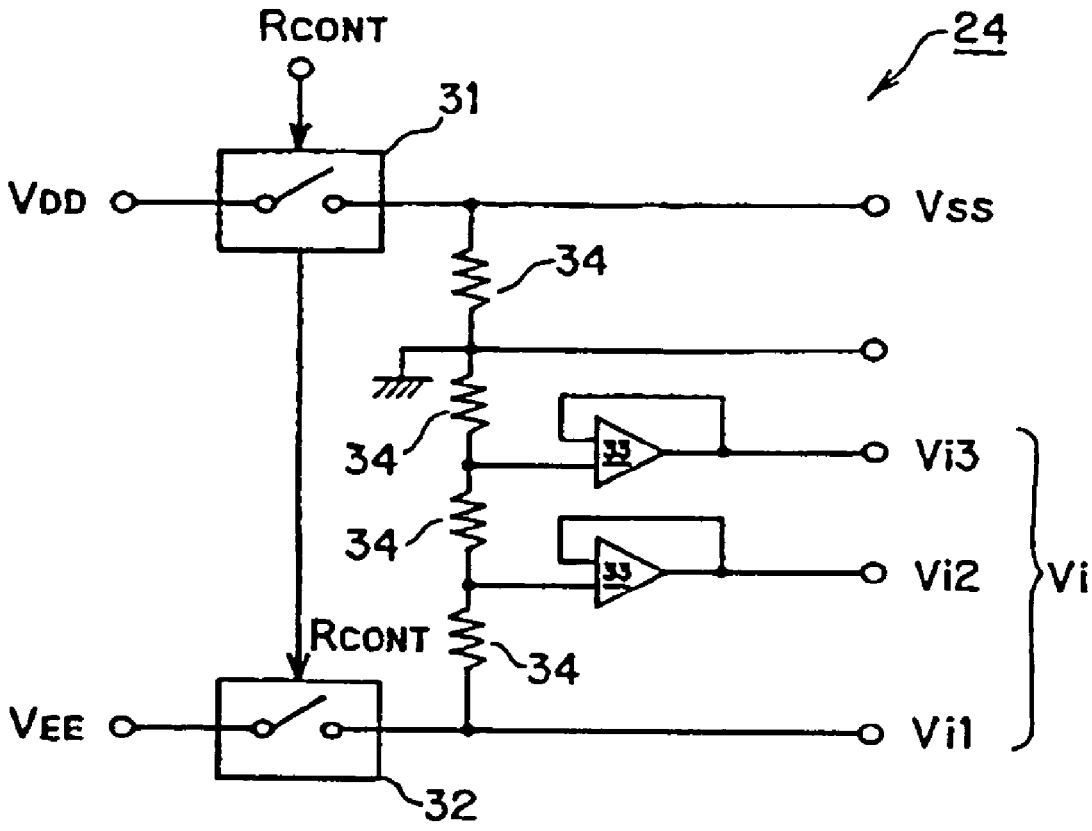
FIG. 6 shows a circuit arrangement view showing one example of drive power supply circuit used in the second embodiment.
Figure 7:
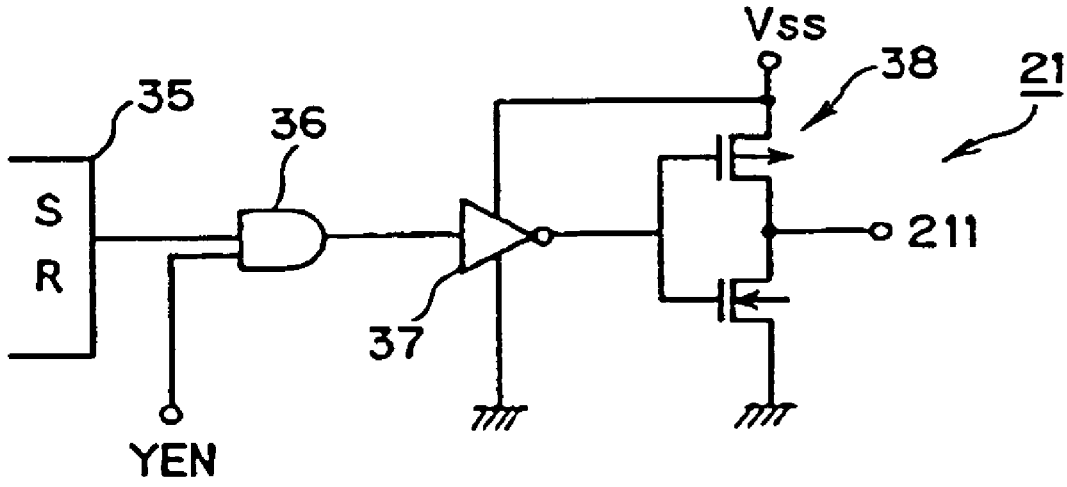
FIG. 7 shows a circuit arrangement view showing one example of row-direction circuit used in the second embodiment.
Figure 8:
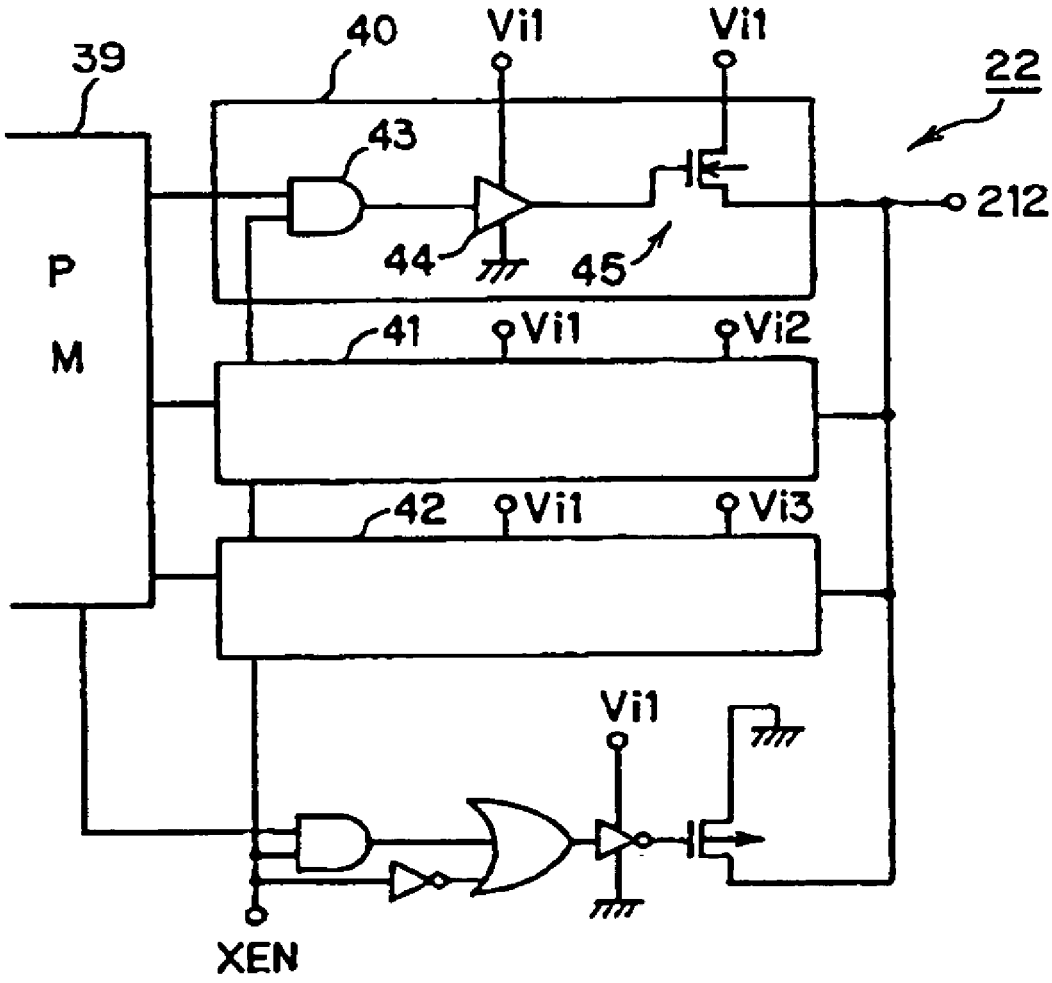
FIG. 8 shows a circuit arrangement view showing one example of column-direction circuit used in the second embodiment.
Figure 9:
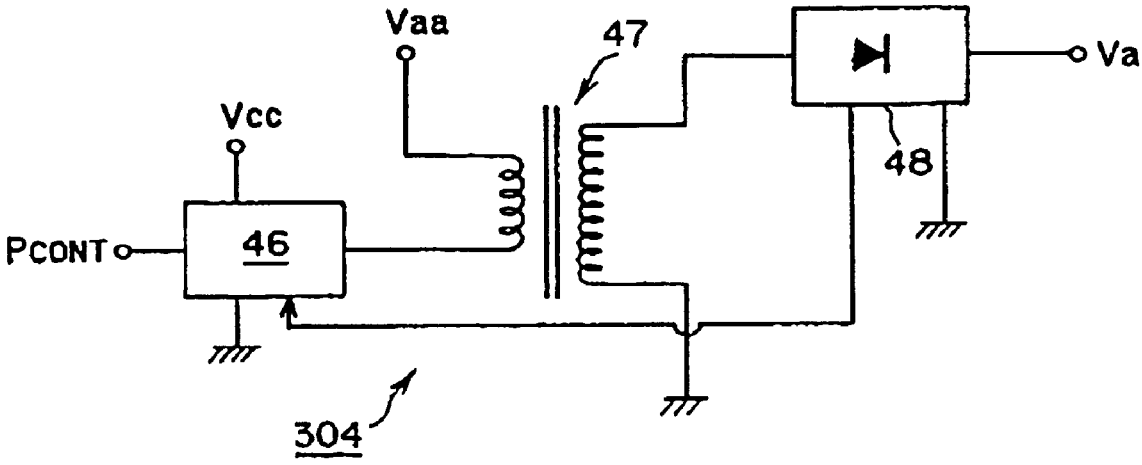
FIG. 9 shows a circuit arrangement view showing one example of anode power supply circuit used in the second embodiment.

FIG. 6 is a circuit diagram of the drive power supply. FIG. 7 is a circuit diagram of a row drive circuit (here, a cathode drive circuit 21). FIG. 8 a circuit diagram of the drive power supply. FIG. 7 is a circuit diagram of a column drive circuit (here, a gate drive circuit 22). FIG. 9 is a circuit diagram of the anode power supply circuit 304. Any of these circuits is provided with a logic circuit in which an operational electrical source is a logic circuit drive potential Vcc such as 5 V or 3.3 V.

A drive power supply circuit 24 shown in FIG. 6 has switches 31,32 which turns on/off supply of potentials VDD and VEE such as +50 V and −50 V corresponding to a control signal RCONT; an operational amplifier 33 with a voltage follower, a plurality of resistors 34. The drive power supply 24 is a multi-power supply which supplies three negative potentials (Vi1, Vi2, Vi3) to the column drive circuit and supplies a scanning selective potential Vss to the row drive circuit.

A row driving circuit (cathode driving circuit 21, in this example) shown in FIG. 7 has a vertical shift register SR35 whose output level is shifted for each row in synchronization with a clock YCLK, an AND gate 36 for controlling application of a potential for non-selective in scanning in dependence on an enable signal YEN, a level shift circuit 37 for boosting its output voltage from low voltages (Vcc to 0 V) for logic circuitry to high voltages (Vss to 0 V) for driving, and a high voltage CMOS inverter 38 on the output stage which outputs a scanning signal for providing a scanning selection potential or a scanning non-selective potential. It should be noted that this FIGURE only shows one channel.

A column driving circuit (gate driving circuit 22, in this example) shown in FIG. 8 has a pulse modulator PM39 for modulating digital display image data input from the driving control circuit 23 into modulated potentials, three selector circuits 40, 41 and 42 for selectively outputting three modulated potentials Vi1, Vi2 and Vi3. The selector circuits 40, 41, 42 have an AND gate 43 for controlling application of the modulated potential by means of an enable signal XEN, a level shift circuit 44, and a high voltage stage CMOS inverter 45 on the output stage, respectively. It should be noted that this figure only shows one channel.

An anode power supply circuit 304 shown in FIG. 9 has a transformer control circuit 46 of feedback control type which controls operations of a high voltage output transformer 47 in response to a control signal PCONT, and a rectifier circuit 48 which rectifies an alternating current that has been transformed into a high voltage. The anode power supply circuit 304 is responsive to the control signal PCONT to transform a potential Vaa supplied from a main power supply 305 to a high level anode potential to be applied to an anode to output the anode potential. It should be noted that the main power supply 305 and the anode power supply circuit 304 may be constructed as one circuit block.

Turning back to FIG. 4, the main power supply 305 supplies the logic circuits in the circuits 21 to 24, 304 with a driving potential Vcc for logic circuitry when the supply plug 26 is connected to a commercial power supply and the main power supply switch 25 on the upstream side of power application. As the main power supply 305 detects the ON state of the main power supply switch 35, it generates a start signal as a display starting signal DS in concurrence with the detection or after some delay, at a time t10 shown in FIG. 5. The ON state of the main power supply switch 25 also causes the main power supply circuit 305 to supply the anode power supply circuit 304 and the driving power supply circuit 24 with their operational voltages that are to be sources for generating the anode potential Va and the reference potentials Vs, Vi for driving.

The driving control circuit 23 is a control means usually having a central arithmetic processing section such as an MPU. The driving control circuit 23 is arranged to apply the control signal PCONT to the anode power supply circuit 304, the control signal RCONT to the driving power supply circuit 24, the clock YCLK, enable signal YEN and control signal YCONT for vertical scanning to the cathode driving circuit 21, and the clock XCLK, enable signal XEN, control signal XCONT and display image data DATA for horizontal scanning to the gate driving circuit 22.

The anode power supply circuit 304 holds a potential of the anode at a specified potential such as a zero potential that is sufficiently lower than a threshold potential Vth at which emission of electrons from the electron emitter can be caused when the control signal PCONT is OFF.

The driving power supply circuit 24 normally outputs a zero potential-, but it begins to apply reference potentials Vs. Vi for driving to the cathode driving circuit 21 and the gate driving circuit 22 at a time t11 shown in FIG. 5 when the input control signal RCONT is ON under a condition in which the driving potential Vcc for logic circuitry. At this time, the outputs of the cathode driving circuit 21 and the gate driving circuit 22 make the transition from a potential indefinite state of high impedance to a zero potential, and the same potentials are held between the cathode and the gate.

At a time t12, when the enable signals XEN, YEN are at a high level, application of high levels of non-selective potentials from the cathode driving circuit 21 to all the cathodes (wirings 211 in the row-direction) is started, and at the almost same time application of low levels of non-selective potentials from the gate driving circuit 22 to all the gates (wirings 212 in the column-direction) is started. This will cause a stop voltage to be applied between the cathode and gate of the electron emission device 200.

At a time t13 after the time t12, the input control signal PCONT is ON, and a high level of anode potential Va is started to be applied from the anode power supply circuit 304 to the anode.

At a time t14 after a certain level of anode potential Va has been reached in dependence on a time constant of the output side of the anode power supply circuit 304, the control signals XCONT, YCONT allow the electron emission device 200 on the intersection of the matrix to be supplied with the driving voltage for display. In other words, the cathode driving circuit 21 starts scanning and starts to supply the display panel 300 with the modulated potentials based on the display image data DATA from the gate driving circuit 22.

In this way, at least one row-directional wiring 211 is selected and supplied with a zero potential for one horizontal scanning period (1H), in synchronization with which a great number of column-directional wirings 212 are supplied with the modulated potentials based on the display image data. One frame of image displaying is achieved by line-sequentially driving wherein such scanning is sequentially performed in the vertical direction. In this case, the stop voltages are applied between the cathodes and gates of the pixels of non-selected row in scanning and the pixels of a row scanned selected in scanning provided with an modulated potentials of black displaying data, and the relevant pixels are in a dark state.

The Third Embodiment

Figure 10:
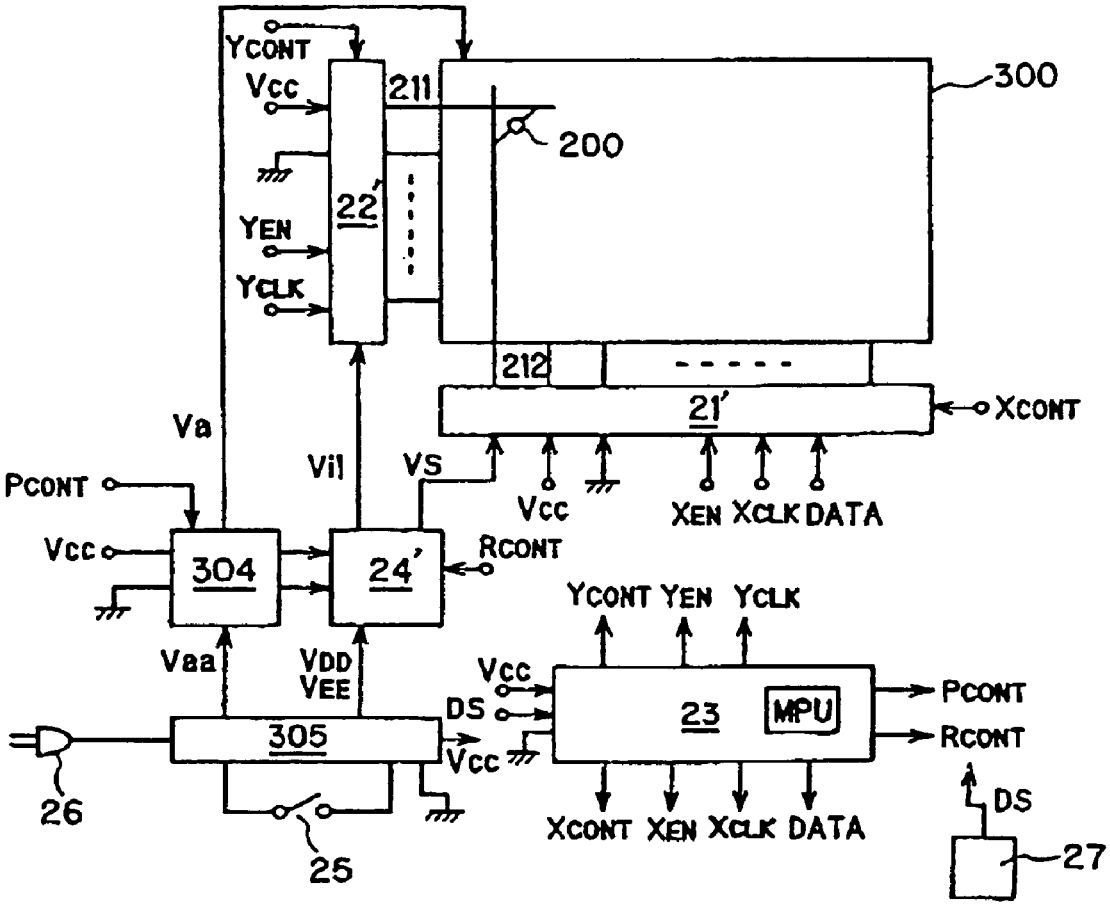
FIG. 10 shows a block diagram of drive control system of display device in the third embodiment of the present invention.
Figure 11:
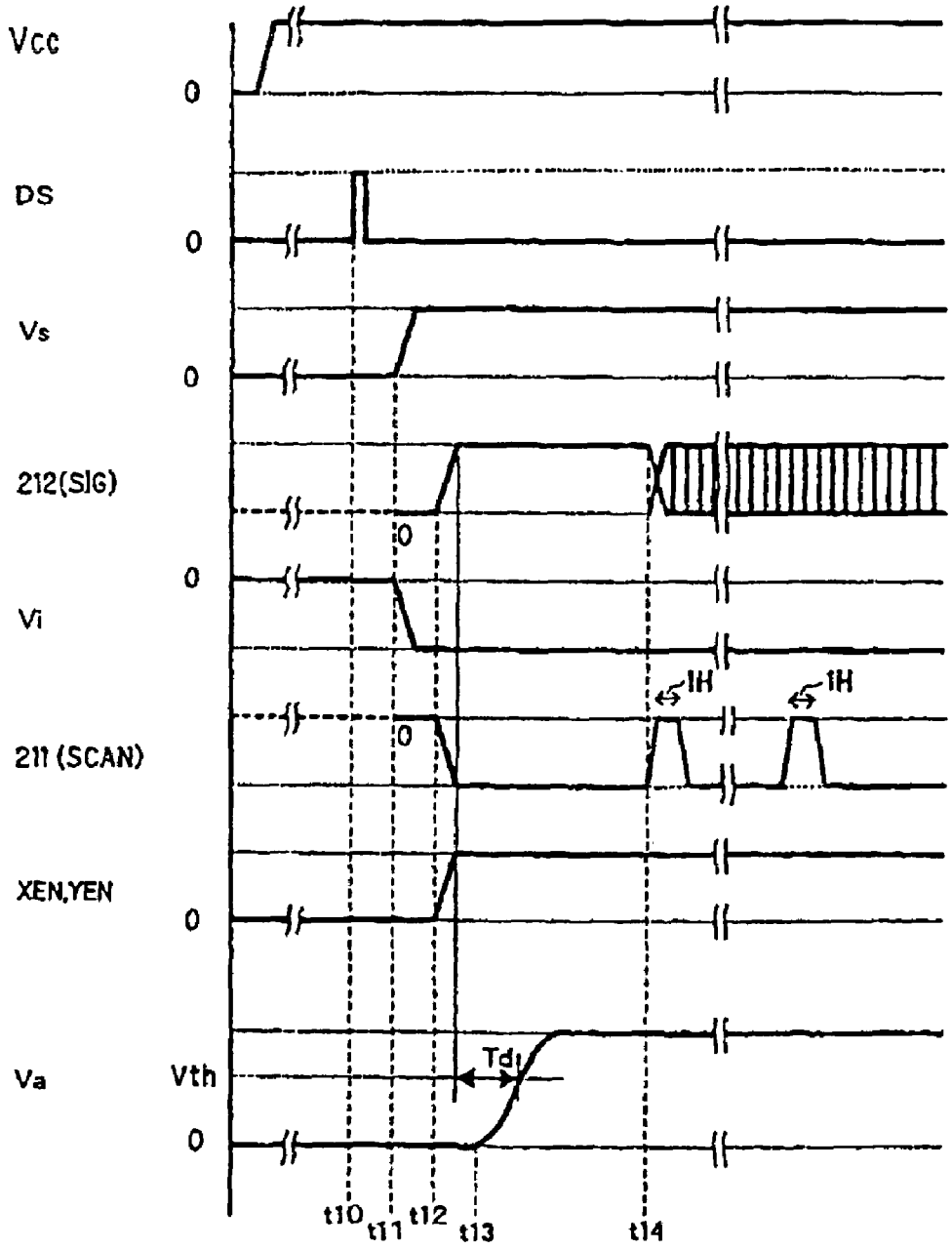
FIG. 11 shows a timing chart of drive control system of display device in the third embodiment of the present invention.
Figure 12A:
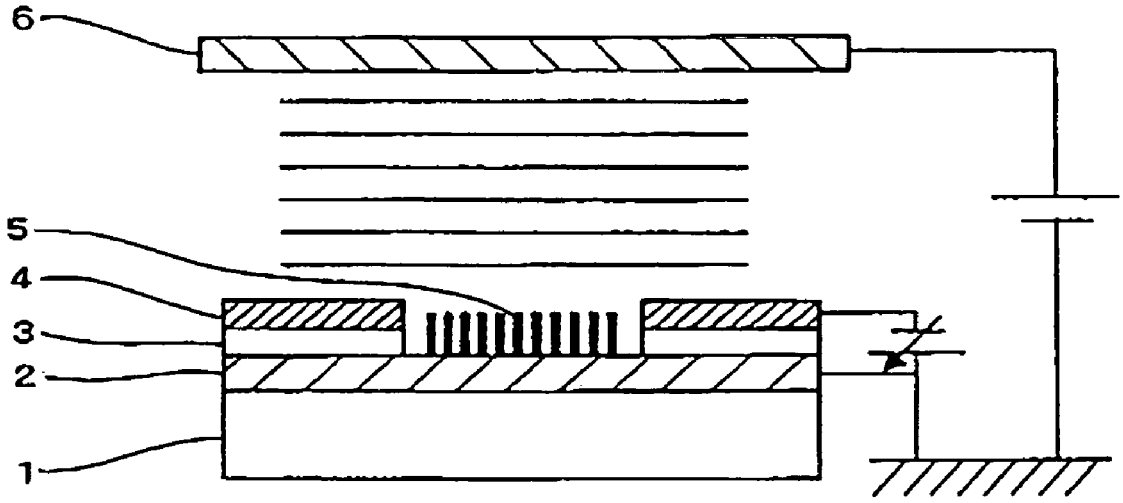
FIG. 12A and FIG. 12B are schematic views for explaining about operation of electrical emission device.
Figure 12B:
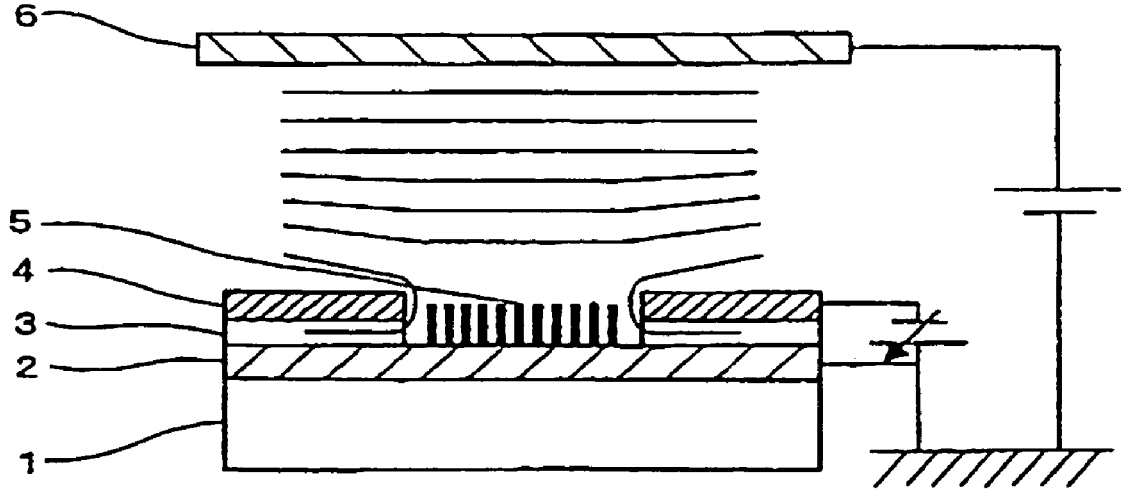

FIG. 10 and FIG. 11 show the third embodiment. In this embodiment, a constitution of the present invention using the various circuits will be described more specifically than the first embodiment as is the case with the second embodiment.

FIG. 10 shows a block diagram of a driving control system of a display device according to the third embodiment of the present invention. FIG. 11 shows a timing chart for explaining a driving control method for a display device according to the third embodiment of the present invention. In this embodiment, detailed description will be omitted about the same constitution and operation as those of FIG. 4 and FIG. 5.

A different point of FIG. 10 from FIG. 4 lies in that the cathode driving circuit 21' is connected to the column-directional wirings 212 and the gate driving circuit 22' is connected to the row-directional wirings 211. Further different point is that the gate driving circuit 22' is supplied with the clock YCLK, enable signal YEN and control signal YCONT for vertical scanning, and the cathode driving circuit 21' is supplied with the clock XCLK, enable signal XEN, control signal XCONT for vertical scanning and the display image data DATA. A yet further different point is that the display starting signal DS is generated from the remote operational module 27 so as to control the driving control circuit 23 in wireless or with wire for operating the display device. Particularly, it should be noted that the details of the circuits 21', 22' and 24' are different in constitution from those of the second embodiment mentioned above.

With reference to FIG. 11, an explanation will be about a sequence in which the power supply plug 26 is connected to the commercial power supply, the main power supply switch 25 on the upstream side of power application is in an ON state, and the transition is made from a non-displaying mode for power saving during which the driving potentials Vcc for logic circuitry is applied to the logic circuits of the circuit to a displaying mode.

Under the condition of the non-displaying mode, a display starting signal DS is generated and applied to the driving control circuit 23 at a time t10 by operation of the remote operational module 27.

The driving power supply circuit 24' usually outputs a zero potential, but it begins to apply the reference potentials Vs, Vi1 for driving to the cathode driving circuit 21' and the gate driving circuit 22' when the input control signal RCONT is ON at a time t11. In this case, the outputs of the cathode driving circuit 21' and the gate driving circuit 22' make the transition from a potential indefinite state of high impedance to a zero potential so that the same potentials are maintained between the cathode and gate.

At a time t12, when the enable signals XEN, YEN are at a high level, a low level of non-selective potential is started to be applied from the gate driving circuit 22' to all the gates (wirings 211 in the row-direction), and at almost the same time a high level of non-selective potential is started to be applied from the cathode driving circuit 21' to all the cathodes (wirings 212 in the column-direction). As a result, stop voltages are simultaneously applied between the cathodes and gates of all pixels.

At a time t13 after the time t12, when the input control signal PCONT is ON, the output from the anode power supply circuit 304 is started to make the transition to a high potential from such a specified potential as a zero potential that is sufficiently lower than the threshold potential Vth at which emission of electrons from the electron emitter can be caused.

At a time t14 after a certain level of anode potential Va has been reached in dependence on a time constant of the output side of the anode power supply circuit 304, the control signals XCONT, YCONT allow the electron emitter on the intersection of the matrix to be provided with the driving voltage for display. In other words, the gate driving circuit 22' starts scanning and starts to supply the display panel 300 with low potentials that have been pulse-modulated based on the display image data DATA from the cathode driving circuit 21'.

In this way, at least one row-directional wiring 211 is selected and applied with a selective potential (zero potential) for one horizontal scanning period (1H) by means of line-sequential scanning of gates and the remainder of the row-directional wirings 211 is supplied with a non-selective potential (negative potential), in synchronization with which a large number of column-directional wirings 212 are supplied with low levels of potentials that have been pulse-modulated based on the display image data. In this case, the stop voltages are applied between the cathodes and gates of the pixels of non-selected row in scanning and the pixels of a row scanned selected in scanning provided with an modulated potentials (positive potentials) of black displaying data, and the relevant pixels are in a dark state.

In the above-mentioned embodiments, the stop voltages may be realized by continuing to provide the modulated potentials based on the all-black displaying data to the gates or cathodes and furthermore vertically scanning the cathodes or gates, or by continuing to provide the modulated potentials based on the all-black displaying data to the gates or cathodes regardless of selection or non-selective of the scanning lines. Alternatively, non-selective voltages may be continued to be applied to all the scanning lines regardless of the modulated potentials. Further alternatively, the stop voltage may be generated on the basis of other potentials than a potential used in the display operation such as the scanning selection potential, the scanning non-selective potential or the modulated potential.

At the time t12, instead of application of the stop voltage, application of a driving voltage that can provide a specified display condition such as all-gray displaying condition or an initial image displaying condition may be started once and then the control may be made in such a way that the specified display condition appears when the anode potential is over the threshold value. In this case, the cathodes or gates are vertically scanned, and the modulated potentials based on the display image data are provided to the gates or cathodes.

Furthermore, after a time t13, following the situation in which a potential of the anode is higher than the threshold value that can lead to emission of electrons from the electron emission device, and then following the situation in which application of the stop voltage is made by supplying all the columns of the display panel 300 with the modulated potentials that can show the darkest state while the rows are being selected line-sequentially, display operation may be performed based on the input display image data after a time t14. Instead of this, after the anode potential Va is higher than the threshold value, following the situation in which application of the driving voltage that can lead to the specified display condition is made by supplying a plurality of columns of the display panel 300 with the predetermined modulated potentials while the rows are being selected line-sequentially, display operation may be performed based on the input display image data after the time t14.

For the modulated potential used in the present invention, a voltage amplitude modulation (PHM) in which a modulated potential is selected from three or more potentials in accordance with a gray-scale display level of the display image data, a pulse-width modulation (PWM) in which a pulse width for a modulated potential is selected from three or more pulse widths in accordance with the same, or a modulation system relying on combination of the PHM and PWM can be adopted. Particularly, if the modulated potential that is to be applied to any one of the cathode wirings and the gate wirings, that is a wiring for a modulated signal, is selected from three or more levels of potentials, then it is preferable that one of them is set as a potential for generating the stop voltage.

The stop voltage used in the present invention may also be generated from a potential other than the potential used in the display operation such as a scanning selection potential, scanning non-selective potential or modulated potential.

The display starting signal DS is not restricted to a signal indicating an ON state of the main power supply switch in the most upstream side of the display device nor an output signal from the remote operational module for operating the display device in wireless or with wire, but may be at least any one of an output signal from the central arithmetic processing section, an output signal from a computer connected with the display device and the like. Additionally, these display starting signals DS are preferably in form of a return signal involved in the matter from the non-displaying mode to the displaying mode, the return signal being generated in the situation that occurs when the anode power supply circuit, the cathode driving circuit and the gate driving circuit are supplied with at least a driving potential Vcc for logic circuitry.

Alternatively, under the situation in which the cathode driving circuit and the gate driving circuit are supplied with at least the reference potential Vs, Vi for driving, the generated return signal (display starting signal) indicating a change from the non-displaying mode to the displaying mode may be used as a trigger and the enable signals XEN, YEN may be generated in response to the return signal to make the cathode driving circuit and the gate driving circuit enable so as to provide the stop voltage.

Although the application of Vcc has been maintained in the non-displaying mode after the switch is turned on, the application of Vcc may be recovered after the display starting signal DS is generated in the situation in which application of Vcc is broken for the anode power supply circuit, the cathode driving circuit and the gate driving circuit.

The electron emission devices for forming the pixels, which are used for the present invention, may be of top gate structure in which the gate is located on the anode side, rather than the cathode side, as shown in the figures. However, they may be of bottom gate structure in which the cathode is located on the anode side, rather than the gate side, and may be of horizontal gate structure in which the cathode and gate are located on the same plane of the substrate (see Japanese Patent Application Laid-Open No 2002-170483, U.S. Patent Publication No. 20020475139, Japanese Patent Application Laid-Open No. 2002-150925, U.S. Patent Publication No. 2,002,074,947 and so on).

In addition, the electron emitters that have a low threshold value of electron emission, used in the present invention, are preferably of fibrous nano-structure consisting of a semiconductor or conductor, or of nano-structure having a carbon material as its main component. Nano-structure specifically includes at least one kind selected from carbon nanotube, graphite nanofiber, amorphous carbon, carbon nonohorne, graphite, diamond like carbon, diamond and fullerene.

In this way, according to the embodiments, when the display starting signal DS is generated, the driving control circuit 23 controls the operation of the display panel driving circuit in such a way that a potential of the anode is higher than a threshold potential Vth at which emission of electrons form the electron emitter can be performed a predetermined time Td after the stop voltage or the driving voltage that can lead to the specified display condition is started to be applied between the cathode and gate, so that it is possible to prevent the occurrence of the undesirable display state and the undesirable light emission.

Additionally, when a material that has a value close to the electron emission threshold value is adopted, the present invention can make generalization to a control method wherein the undesirable electron emission is suppressed even if the unexpected rise in voltage between the cathode and anode occurs, so that the present invention is not restricted to normally-on types but can be applied to normally-off types.

EXAMPLE

Example 1

The display panel as shown in FIG. 2 was manufactured as follows.

In a substrate having been sufficiently cleaned, a cathode 202 was formed in arrangement taking the form of parallel continuous stripes with a thickness of about 1 μm and a width of 300 μm in spattering and photolithography using an aluminum base wiring material.

Subsequently, TIN was formed in a portion to be an electron emitter 205 on the cathode 202 as a close adherence layer and Pd/Co (50% by weight, respectively) was formed on it as a catalyst layer in spattering and photolithography with δ10 μm. It should be noted that otherwise manner can be done in which Fe or Ni, or a mixture of them and the above-mentioned Pd, Co and so on may be used for the catalyst layer.

In the portion thereon except the electron emitter 205, $SiO_2$ was formed as an interfacial insulating layer with a thickness of about 2 μm in spattering and photolithography.

Furthermore, as in the case with the cathode 202, a gate 204 was formed on the interfacial insulating layer in arrangement taking the form of continuous parallel stripes intersecting the cathodes 202 at right angles with a thickness of about 0.5 μm and a width of 200 μm.

The gate 204 was then provided with a hole section 210 with an opening diameter of δ20 μm at a location lying right on the electron emitter 205.

It should be noted that the figure only shows each one of the electron emitter 205 and hole section 210 mentioned above for each electron emission device 200 but a plurality of emitters and/or hole sections may be provided for it.

Thereafter the electron source substrate 201 was subjected to a thermal treatment in the atmosphere to oxidize the Pd/Co respectively, and then it was put in the CVD apparatus and a thermal treatment takes place while hydrogen is flowed into the CVD apparatus so as to hydrogen-reduce the palladium oxide and cobalt oxide and make them to be fine-grained.

Next, it was subjected to a thermal treatment for one hour at 550 degrees Celsius while ethylene is flowed into it. Namely, by the thermal CVD, graphite nano-fiber (GNP) having structure in which a great number of graphenes are stacked in a longitudinal direction of the fiber as the electron emitters 205 was formed on the close adherence layer of TIN by the action of the catalyst. It should be noted that hydrocarbon gas such as acetylene or methane may be used instead of the ethylene, and the similar GNF can be formed by appropriately choosing the flowing amount of gas, temperature, time and so on.

The thus manufactured electron source substrate 201, a faceplate 206 having been manufactured beforehand and an outer frame 214 were heated at 400 degrees Celsius in a vacuum chamber which had been evacuated at a pressure of $10^{-7}$ Pa or less, by using glass frits to form an envelope.

It should be noted that in this case the atmospheric pressure supporting structure was formed by disposing a spacer (not shown) on the electron source substrate 201 in an X-direction so that the anode (metal back 209) of the faceplate 206 were opposed to each other and held with a gap of 2 mm by the outer frame 214 and the spacer.

It has been found that electron emission is performed from the condition of Va=7 kV (this is an electron emission threshold voltage between the cathode 202 and the anode) and the phosphor 208 of the faceplate 206 makes light emission as the anode is supplied with the potential Va and the anode potential is gradually increased in a situation where the cathode 202 of the display panel manufactured in the above mentioned way is at 0 V and the gate 204 is at 0 V, and that a threshold intensity of the electrical field of the electron emission device 200 is about 3.5 V/μm. Furthermore, by application up to Va=20 kV, the intensity of electrical field between the cathode 202 and the anode is 5 V/μm to make it to be reliably operated as a normally-on type electron emission device 200.

In order to check the stop voltage between the thus-manufactured cathode 202 and gate 204 of the electron emission device 200, the potential Vx applied to the row-directional wirings 211 that is a cathode 202 remains at 0 V and the potential Vy applied to the column-directional wirings 212 being gates 204 is gradually increased. Under these conditions, the electron emission could be broken at Va=10 kV in Vy=−50 V. In other words, it has been found that a stop voltage between the cathode 202 and the gate 204 is −50 V (gate voltage in the case of the cathode side being at 0 V).

Then, as shown in FIG. 3, the scanning signal application means 301 were connected to the row-directional wirings 211 of the display panel 300, and the modulation signal application means 302 were connected to the column-directional wirings 212.

After a predetermined delay time elapse on condition that the display starting signal DS outputted from the control circuit 303 was made at a high level and Vx=Vy=0 V is maintained, the electron emission was broken by applying Vx=50 V and Vy=−50 V between the cathode 202 and the gate 204 of the device. It should be noted that the emission of electrons from the electron emitter 205 toward the anode can be broken even in the case of only application of Vx=50 V or Vy=−50 V as mentioned above.

Then, purposing that Td shown in FIG. 1 gets 200 ms, a control signal was fed from the control circuit 303 to the anode power supply circuit 304 to begin application of Va=10 kV. It should be noted that an electron emission threshold potential (Vth) of the anode in the present example is 7 kV.

Also the image displaying was performed in a line-sequential manner based on the display image data under the conditions in which a scanning selection potential is at 0 V, a scanning non-selective potential +50 V, a modulated potential for white 0 V, and a modulated potential for black +50 V.

According to this Example 1, an image displaying based on the input display image data could be smoothly started without leading to all-white displaying on the occasion of turning on the power supply during the power-on sequence.

Example 2

As is the case with the Example 1, it was possible to form carbon nanotube (CNT) of the structure in which the graphene is cylindrical in the known method by appropriately choosing the conditions of the catalyst layer and the thermal CVD and to similarly obtain an electron emission device having a threshold electrical field strength of about 3.5 V/im.

As is the case with the Example 1, application of Va=10 kV led to an electron emission device of the normally-on type, and it was found that the stop voltage between the cathode and gate at that time was approximately −50 V.

Even in the Example 2, an image displaying based on the input display image data could be smoothly started without leading to all-white displaying on the occasion of turning on the power supply during the power-on sequence.

As above-explained, the present invention can prevent a situation in which all-white displaying occurs when the anode potential is caused to make the transition from the cutoff state to the application state in accordance with the occurrence of the display starting signal, for example on the occasion of turning on the power supply, and can start a natural image displaying. Therefore, even for a short time, it is possible to prevent a phenomenon in which a user misunderstands the failure of the device and/or feels uncomfortable.

What is claimed is:

1. A display device comprising:

a display panel having cathodes, gates, and an anode in which said cathodes and said gates are connected in a matrix manner;

an electron emitter which emits electrons in a state where a voltage is applied only between said cathodes and said anode and which is provided with said cathodes;

in which display of a plurality of pixels in said display panel is performed under a dark state by stopping electron emission from said electron emitter for said anode by applying a stop voltage between said cathodes and said gates, and control means which controls operation of a circuit for driving a display panel in such a way that a potential of said anode becomes not less than a threshold value potential by which a potential of said anode can perform electron emission from said electron emitter after a predetermined time elapse from starting of application of a drive voltage which provide provides a specified display state or the stop voltage between said cathodes and said gates when a display starting signal is generated.

2. The display device according to claim 1, wherein application of the stop voltage between said cathodes and said gates and the drive voltage which provides the specified display state is performed for all of said pixels of said display panel at the same time.

3. The display device according to claim 1, wherein a scanning selective potential is supplied to at least one line scanning wiring in said display panel, a scanning non-selective potential is supplied to remaining scanning wirings in said display panel, a predetermined potential which generates the darkest state for each pixel is supplied to all columns of said display panel in synchronization with supply of the scanning selective potential or a predetermined modulation potential is supplied, whereby the stop voltage or the drive voltage which provides the specified state is applied between said cathodes and said gates.

4. The display device according to claim 1, wherein said display panel drive circuit has:

an anode power supply circuit for supplying the anode potential;

a cathode drive circuit for driving said cathodes;

a gate drive circuit for driving said gates; and a drive power supply circuit for supplying a driving reference voltage for generating a drive voltage which provides the stop voltage or the specified display state to said cathode drive circuit and said gate drive circuit.

5. The display device according to claim 4, wherein said drive power supply circuit starts supplying the driving reference voltage under a state where a drive potential for a logic circuit to said cathode drive circuit and said gate drive circuit, supply of the driving reference voltage starts, and thereafter said cathode drive circuit and said gate drive circuit start application of the stop voltage or the driving voltage which provides the specified display state.

6. The display device according to claim 4, wherein a terminal when application of the stop voltage or the driving voltage provides the specified display state, said anode power supply circuit holds said anode so as to have a specified potential sufficiently lower than the threshold value potential which emits electrons from said electron emitter under a state where a drive potential for a logic circuit is supplied to said anode power supply circuit.

7. The display device according to claim 4, wherein after application of stop voltage or the drive voltage which provides the specified display state starts, application of drive voltage is permitted based on input display image data from said cathode drive circuit and said gate drive circuit to said display panel.

8. The display device according to claim 1, wherein after the voltage between said cathodes and said gates is transited from an unstable state to zero, application of the stop voltage and the drive voltage which provides the specified display state starts.

9. The display device according to claim 1, wherein any one of first and second supply steps is performed, said first step of supplying scanning non-selective potential which applies the stop voltage irrespective of a potential of the other wiring to any one of cathode wirings and gate wirings which are defined by scanning wirings of said display panel; and said second step of supplying a modulation potential which applies a drive voltage that provides the specified display state or the stop voltage irrespective of a potential of the other wiring defined by said scanning wirings to any one of said cathode wirings and said gate wirings which are defined by modulation signal wirings, whereby the stop voltage or the drive voltage which provides the specified display state is applied between said cathodes and said gates.

10. The display device according to claim 1, wherein a modulation potential to be supplied to any one of cathode wiring and gate wiring which are defined by modulation signal wirings of said display panel is a potential selected from three or more levels, and potentials at two or more levels from among them are potentials which generate a drive voltage which may emit electrons by allowing said two or more level potentials to be supplied in synchronization with said scanning selective potential, and one of them is a potential which generates the stop voltage.

11. The display device according to claim 1, wherein said emitter is at least one kind selected from carbon nanotube, graphite nanofiber, amorphous carbon, carbon nonohorne, graphite, diamond like carbon, diamond and fullerene.

12. A drive control method for a display device having a display panel having cathodes, gates, and an anode in which said cathodes and said gates are connected in a matrix manner, and an electron emitter which emits electrons in a state where a voltage is applied only between said cathodes and said anode and which is provided with said cathodes, in which display of pixels of said display panel is performed under a dark state by stopping electron emission from said electron emitter for said anode by applying a stop voltage between said cathodes and said gates, said method comprising:

an application step of applying stop voltage or a drive voltage which provides a specified display state between said cathodes and said gates when a display starting signal is generated; and an anode voltage supplying step of allowing a potential of said anode not to be less than a threshold value potential which emits electrons from said electron emitter after a predetermined time elapse from starting of said application step.

13. The drive control method for the drive device according to claim 12, wherein a driving power supply circuit starts supplying a driving reference potential for generating the stop voltage or a drive voltage which provides the specified display state to a cathode drive circuit and a gate drive circuit under a state where a drive potential for a logic circuit is supplied to a cathode drive circuit and a gate drive circuit;

thereafter, said application step starts, and at a starting time of said application step, an anode power supply circuit holds said anode at a specified voltage which is sufficiently lower than a threshold voltage which may perform electron emission from said electron emitter under a state where the drive potential for said logic circuit is supplied to an anode power supply circuit; and further thereafter, said anode voltage supplying step starts, said anode is held at a voltage which is sufficiently higher than the threshold potential which performs electron emission from said electron emitter, and application of the drive voltage for display is permitted based on a display image input to said display panel from said cathode drive circuit and said gate drive circuit.

14. A display device comprising:

a display panel having cathodes, gates, and an anode respectively connected to a cathode driving circuit, a gate driving circuit, and an anode power source circuit, in which said cathodes and said gates are connected in a matrix manner; an electron emitter which emits electrons in a state where a voltage is applied only between said cathodes and said anode, said electron emitter being provided with said cathodes, in which display of a plurality of pixels in said display panel is performed under a dark state by stopping electron emission from said electron emitter to said anode by applying a stop voltage between said cathodes and said gates; and a control circuit which controls said cathode driving circuit, said gate driving circuit, and said anode power source circuit, wherein said control circuit outputs a display starting signal to said cathode driving circuit, said gate driving circuit, and said anode power source circuit, and controls operations of circuits for driving the display panel in such a way that a potential of said anode becomes not less than a threshold value potential by which said potential of said anode can perform electron emission from said electron emitter after a predetermined time elapse from starting of application of a drive voltage which provides a specified display state or the stop voltage between said cathodes and said gates after a predetermined time elapse from a time at which the display starting signal is outputted after potentials of said cathode and said gate are kept at a same potential.

15. The display device according to claim 14, wherein said electron emitter includes at least one kind selected from carbon nanotube, graphite nanofiber, amorphous carbon, carbon nonohorne, graphite, diamond like carbon, diamond and fullerene.

16. A drive control method of a display device having a display panel having cathodes, gates, and an anode in which said cathodes and said gates are connected in a matrix manner; an electron emitter which emits electrons in a state where a voltage is applied only between said cathodes and said anode, said electron emitter being provided with said cathode, in which display of a plurality of pixels in said display panel is performed under a dark state by stopping electron emission from said electron emitter to said anode by applying a stop voltage between said cathodes and said gates, said method comprising:

a step of generating a display starting signal;

an application step of applying a drive voltage which provides said stop voltage or a specified display state between said cathodes and said gates after a predetermined time elapse from a time at which the display starting signal is generated after potentials of said cathodes and said gates are kept at a same potential; and an anode potential supplying step of allowing a potential of said anode not to be less than a threshold value potential which emits electrons from said electron emitter after a predetermined time elapse from starting of said application step.

17. A display device comprising:

a display panel having cathodes, gates, and an anode respectively connected to a cathode driving circuit, a gate driving circuit, and an anode power source circuit, in which said cathodes and said gates are connected in a matrix manner; an electron emitter which emits electrons in a state where a voltage is applied only between said cathodes and said anode, said electron emitter being provided with said cathodes, in which display of a plurality of pixels in said display panel is performed under a dark state by stopping electron emission from said electron emitter to said anode by applying a stop voltage that a potential of each of said gates is lower than a potential of each of said cathodes between said cathodes and said gates; and a control circuit which controls said cathode driving circuit, said gate driving circuit, and said anode power source circuit, wherein said control circuit outputs a display starting signal to said cathode driving circuit, said gate driving circuit, and said anode power source circuit, and controls operations of circuits for driving the display panel in such a way that a potential of said anode becomes not less than a threshold value potential necessary to perform electron emission from said electron emitter by the potential of said anode after a predetermined time elapse from starting of application of the stop voltage between said cathodes and said gates of all pixels of said display panel at the same time after a predetermined time elapse from a time at which the display starting signal is outputted after potentials of said cathodes and said gates are kept at a same potential.

18. The display device according to claim 17, wherein a scanning selective potential is supplied to at least one line scanning wiring of said display panel, a scanning non-selective potential is supplied to remaining scanning wirings, said stop voltage is applied between said cathodes and said gates by supplying a modulation potential which generates the darkest state for each pixel to all modulation signal wirings of said display panel in synchronization with supply of said scanning selective potential.

19. The display device according to claim 17, wherein after the voltage between cathodes and gates is transited from an unstable state to zero, application of the stop voltage starts.

20. The display device according to claim 17, wherein said electron emitter includes at least one kind selected from carbon nanotube, graphite nanofiber, amorphous carbon, carbon nonohorne, graphite, diamond like carbon, diamond and fullerene.

21. A drive control method of a display device having a display panel having cathodes, gates, and an anode, in which said cathodes and said gates are connected in a matrix manner; an electron emitter which emits electrons in a state where a voltage is applied only between said cathodes and said anode, said electron emitter being provided with said cathodes, in which display of each of pixels is performed under a dark state by stopping electron emission from said electron emitter to said anode by applying a stop voltage that a potential of each of said gates is lower than a potential of each of said cathodes between and said gates, said method comprising:

a step of generating a display starting signal;

an application step of applying a stop voltage between said cathodes and said gates of all pixels of said display panel at the same time after a predetermined time elapse from a time at which the display starting signal is generated after potentials of said cathodes and said gates are kept at a same potential; and an anode potential supplying step of allowing a potential of said anode not to be less than a threshold value potential necessary to perform electron emission from said electron emitter after a predetermined time elapse from starting of said application step.

* * * * *

UNITED STATES PATENT AND TRADEMARK OFFICE

CERTIFICATE OF CORRECTION

PATENT NO. : 7,224,331 B2
APPLICATION NO. : 10/697278
DATED : May 29, 2007
INVENTOR(S) : Shigeki Yabu et al.

It is certified that error appears in the above-identified patent and that said Letters Patent is hereby corrected as shown below:

COLUMN 1:

Line 24, “molybdenium” should read --molybdenum--.
Line 45, “fluerene,” should read --fullerene,--.

COLUMN 3:

Line 17, “typed” should read --type--.
Line 18, “typed” should read --type-- and “flat-typed” should read --flat-type--.
Line 31, “when” should read --in--.

COLUMN 5:

Line 40, “affection” should read --attraction--.
Line 44, “fist” should read --first--.

COLUMN 7:

Line 46, “fist” should read --first--.
Line 56, “normally-on-typed” should read --normally-on-type--.

COLUMN 8:

Line 15, “stripe” should read --striped--.

COLUMN 9:

Line 22, “an” should be deleted.
Line 23, “enough” should read --sufficient--.

UNITED STATES PATENT AND TRADEMARK OFFICE

CERTIFICATE OF CORRECTION

PATENT NO. : 7,224,331 B2
APPLICATION NO. : 10/697278
DATED : May 29, 2007
INVENTOR(S) : Shigeki Yabu et al.

It is certified that error appears in the above-identified patent and that said Letters Patent is hereby corrected as shown below:

COLUMN 11:

Line 21, “hysteresis It” should read --hysteresis, it--.
Line 23, “generate” should read --generates--.
Line 31, “control” should read --controlling--.

COLUMN 12:

Line 1, “detailed” should read --detail--.
Line 8, “panes” should read --panel--.

COLUMN 17:

Line 23, “20020475139,” should read --2002/047513,--.
Line 25, “2,002,074,947” should read --2002/074947--.
Line 39, “form” should read --from--.

COLUMN 18:

Line 2, “δ10 µm.” should read --Ö10 µm.--.

COLUMN 19:

Line 22, “purposing” should read --supposing--.

COLUMN 20:

Line 20, “provide” should be deleted.

UNITED STATES PATENT AND TRADEMARK OFFICE

CERTIFICATE OF CORRECTION

PATENT NO. : 7,224,331 B2
APPLICATION NO. : 10/697278
DATED : May 29, 2007
INVENTOR(S) : Shigeki Yabu et al.

It is certified that error appears in the above-identified patent and that said Letters Patent is hereby corrected as shown below:

COLUMN 22:

Line 63, "cathode," should read --cathodes,--.

COLUMN 24:

Line 29, "between" should read --between said cathodes--.

Signed and Sealed this

Twenty-first Day of October, 2008

JON W. DUDAS
*Director of the United States Patent and Trademark Office*